US005315338A

United States Patent [19]

Frank et al.

[11] Patent Number: 5,315,338

[45] Date of Patent: * May 24, 1994

[54] APPARATUS FOR ENHANCING HEAT AND MASS TRANSFER IN A FLUID MEDIUM

[75] Inventors: Lee F. Frank, Rochester; Jeffrey L. Helfer, Webster; Haribbajan S. Kocher, Penfield; Paul W. Wagner, Holley, all of N.Y.

[73] Assignee: Eastman Kodak Company, Rochester, N.Y.

[ * ] Notice: The portion of the term of this patent subsequent to Aug. 4, 2009 has been disclaimed.

[21] Appl. No.: 919,660

[22] Filed: Jul. 24, 1992

Related U.S. Application Data

[63] Continuation of Ser. No. 633,505, Dec. 28, 1990, Pat. No. 5,136,323.

[51] Int. Cl.[5] ..... G03D 3/08

[52] U.S. Cl. ..... 354/320; 354/324

[58] Field of Search ..... 354/297, 300, 319, 320, 354/317; 34/155, 160, 225, 233

[56] References Cited

U.S. PATENT DOCUMENTS

| | | | |
|---|---|---|---|
| 3,041,739 | 7/1962 | Meir-Windhorst | 34/156 |
| 3,192,846 | 7/1965 | Wright | 95/94 |
| 3,324,570 | 6/1967 | Flaith et al. | 34/156 |
| 3,372,630 | 3/1968 | Schmidt | 95/89 |
| 3,403,456 | 10/1968 | Smith, Jr. | 34/160 |
| 3,405,627 | 10/1968 | Day et al. | 95/94 |
| 3,457,898 | 7/1969 | Frauchiger et al. | 354/325 |
| 3,516,345 | 6/1970 | Meyer | 354/319 |
| 3,595,159 | 7/1971 | Bull | 95/94 |
| 3,610,131 | 10/1971 | Frick et al. | 95/94 |
| 3,635,144 | 1/1972 | Beck | 95/89 R |
| 3,641,911 | 2/1972 | Aelterman | 95/94 R |
| 3,688,677 | 9/1972 | Frick et al. | 95/94 R |
| 3,774,521 | 11/1973 | Beck | 95/89 |
| 3,791,345 | 2/1974 | McCutcheon | 118/637 |
| 3,805,409 | 4/1974 | Sato et al. | 34/160 |
| 3,900,959 | 8/1975 | Breschi et al. | 34/155 |
| 3,988,756 | 10/1976 | Wick et al. | 354/319 |
| 4,327,987 | 5/1982 | Friar et al. | 354/317 |
| 4,359,279 | 11/1982 | Popoff | 354/320 |
| 4,467,537 | 8/1984 | Trotscher | 34/155 |
| 4,577,949 | 3/1986 | Geyken et al. | 354/319 |
| 4,594,795 | 6/1986 | Stephansen | 34/68 |
| 4,647,173 | 3/1987 | Schar | 354/319 |
| 4,758,857 | 7/1988 | Tanska | 354/320 |

*Primary Examiner*—D. Rutledge
*Attorney, Agent, or Firm*—Frank Pincelli

[57] ABSTRACT

A processor having an elongated channel for receiving a web to be treated with a fluid. The fluid is injected into the channel at one or more injection sites. Fluid is evacuated from the channel at spaced evacuation sites and spaced therefrom such that fluid will flow from the injection site to the evacuation sites with laminar flow and be evacuated when the boundary layer of the fluid reaches a predetermined minumim thickness.

8 Claims, 7 Drawing Sheets

APPARATUS FOR ENHANCING HEAT AND MASS TRANSFER IN A FLUID MEDIUM

This is a Continuation of application Ser. No. 07/633,505, filed Dec. 25, 1990, now U.S. Pat. No. 5,136,323.

TECHNICAL FIELD

This invention relates to apparatus for transferring thermal energy or chemical mass through a fluid medium and, more specifically, to such transfer in the processing of light sensitive material such as photographic film or paper.

BACKGROUND ART

Conventional film (or paper) processing devices do not provide a sufficient level of agitation at the film-liquid interface. As a result, a layer of liquid that is depleted of reactants and enriched in reaction by-products exists at the film surface. This layer is the chemical boundary layer. During photographic processing, this boundary layer can influence both the rate at which photochemicals are transferred to and from the film, as well as their concentrations within the film. Either influence can affect the rate and quality of processing. An analogous thermal boundary layer, a region of reduced temperature, is created in the layer of gas which exists at the film surface during the drying portion of the processor.

Analysis and experimental measurements of conventional processors indicate that boundary layers exist which are thick enough so as to become the processing rate limiting parameter. More specifically, the transfer of chemical mass and heat energy through the chemical and thermal boundary layers occurs more slowly than transfer through the film itself. This condition results in low processing speeds, excessively long processing paths and increased size of the processor, including the dryer section. Also, the chemical concentrations in the processor boundary layer need to be excessively high to maintain reasonable mass transport rates resulting in inefficient utilization of the processing chemicals. In the dryer section of the processor drying, temperatures need to be excessively high to maintain reasonable film drying rates resulting in inefficient utilization of thermal energy.

The rate of chemical mass transfer through this boundary layer to the film surface can be approximated to the first degree by the following equation:

$$\frac{m}{A} = \frac{D}{\delta} \Delta C$$

where:

m=Mass Transfer Rate (Grams/sec)

A=Film Area ($cm^2$)

D=Chemical Diffusivity ($cm^2$/sec)

$\delta$=Boundary Layer Thickness (cm)

$\Delta C$=Concentration Gradient (Grams/$CM^3$)

The ratio of diffusivity/delta is typically called the mass transfer coefficient. A high mass transfer coefficient will result in a high chemical mass transfer rate, for a given concentration difference between the film and bulk solution concentration. Diffusivity is a function of such variables as molecule size and temperature. While diffusivity can easily be increased by increasing processing solution temperatures (thereby increasing chemical mass transfer rates), this involves the use of complicated equipment and increased cost of processing. Alternatively the chemical mass transfer rate can be increased by decreasing the chemical boundary layer thickness independent of increaseing temperature.

It is known in the prior art that increased agitation decreases boundary layer thickness and that decreased boundary layer thickness produces an increase in developed film density. Also it is known that increased temperatures increase chemical diffusivity. Further, it is known that treating film with a continuous spray (jet impingement) on turbulent flows provides a high degree of agitation, and high reductions in boundary layer thickness. The paper "Heat Transfer Characteristics of Impinging Two Dimensional Air Jets," Gordon and Akfirat, *Journal of Heat Transfer,* February 1966, pages 101–108, outlines studies of impinging air jets in the heat transfer domain. The results reported indicate that very high heat transfer coefficients can be obtained through the use of direct impinging jets, that the high heat transfer coefficient falls off quite rapidly with increasing distance from the center or stagnation point of the impinging jet, and that the rapid fall off produces an average coefficient over a longer area of impingement that is substantially less than the maximum value.

Typically high turbulent flow rates or jet impingement have been used to achieve adequate mixing. The problem with increasing agitation through turbulence or with jet impingement is that it is extremely difficult to achieve uniformity of the treatment process since any non-laminar fluid condition contains non uniform fluid disturbances such as pockets of turbulence, eddy currents, etc. Also turbulent flows dissipate a great deal of energy in places where it does no useful work, specifically areas away from the film surface. This is due to the high "shearing" action that occurs within the turbulent flow field. Moreover, with turbulent flows and jet impingement it is difficult to treat large areas where uniformity is ever a greater problem.

For the above reasons processors in current use are typically roller transport processors where film or paper is transported by rollers through a tank of solution. While such processors provide more uniform processing than impinging jets or turbulent flows, they are massive in size, inefficient and thus subject to the boundary layer problems discussed above.

DISCLOSURE OF THE INVENTION

It is an object of the present invention to provide a processor which minimizes the above effects by providing laminar flow of a web treating fluid and reducing the rapid build up of the boundary layer and subsequent decrease in chemical or heat transfer rate.

In accordance with the invention, means are provided which define an elongated channel for receiving a web (in continuous or sheet form) to be treated with a fluid. The fluid is injected into the channel at one or more injection sites. Fluid is evacuated from the channel at spaced evacuation sites. The injection site is positioned between two evacuation sites and spaced therefrom such that fluid will flow from the injection site to the evacuation sites with laminar flow and be evacuated when the boundary layer of the fluid reaches a predetermined minimum thickness.

BRIEF DESCRIPTION OF THE DRAWINGS

Other objects, features and advantages will become apparent from the following description taken in connection with the following drawings wherein.

MODE OF CARRYING OUT THE INVENTION

While the invention will be disclosed in connection with the treatment of light sensitive materials, it is to be understood that the invention is applicable to any treatment process that is rate limited by the diffusion of chemicals or chemical energy through an adjacent aqueous or gaseous boundary layer or to any process that is rate limited by the transfer of heat through an adjacent thermal boundary layer. Also, it is to be understood that the term "fluid" encompasses both gaseous and liquid mediums including air and water.

Figure 1:
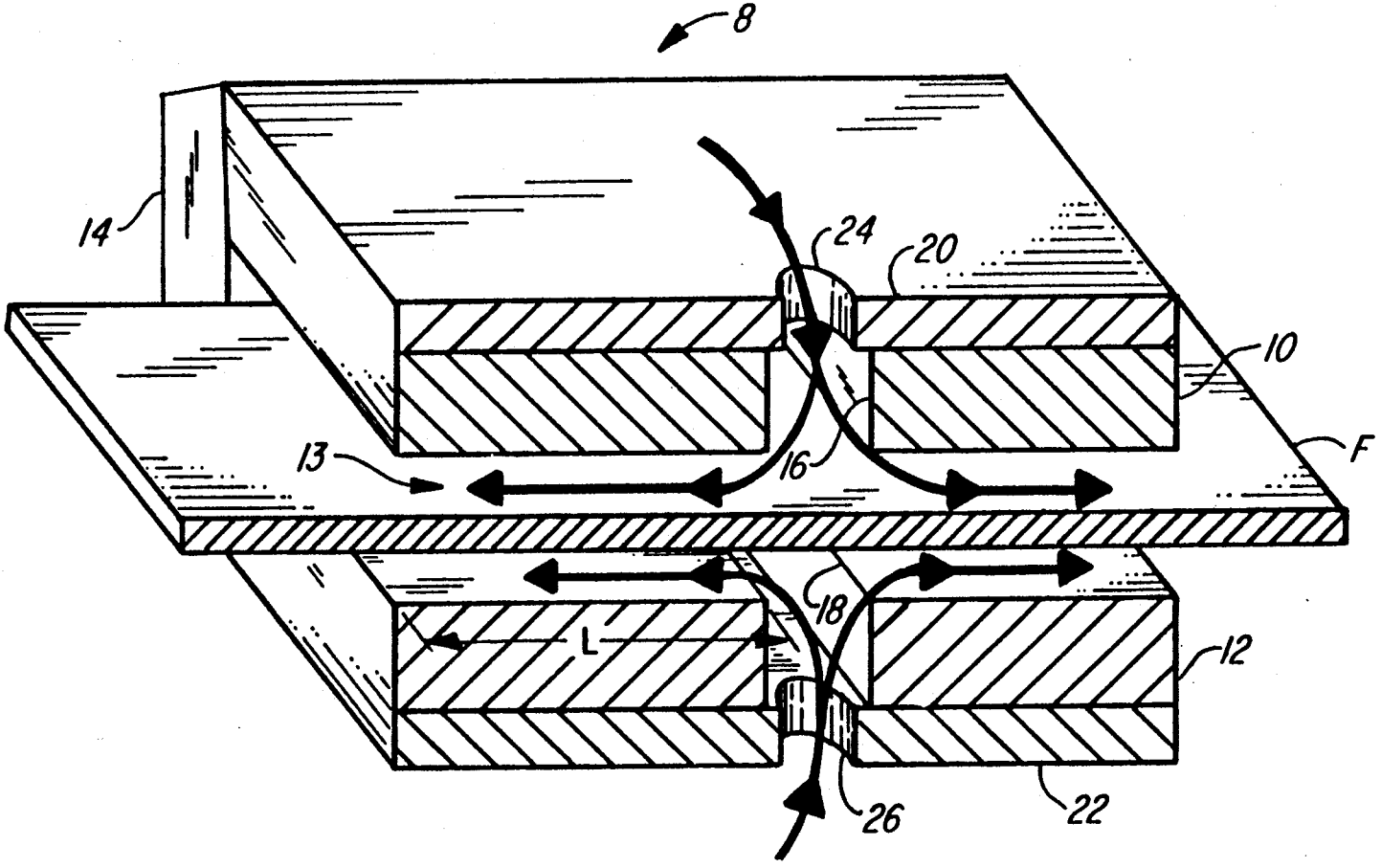
FIG. 1 is a perspective view in partial section illustrating a portion of a parallel plate processor in accordance with the invention.

Referring to FIG. 1 of the drawings, there is shown a basic parallel plate processor 8 for circulating a processing fluid into contact with light sensitive material such as a photographic film (or paper) F. The processor illustrated in FIG. 1 comprises a pair of spaced parallel plates 10, 12 defining a channel 13 for the transport of the film F therebetween. The plates are supported by front and rear end walls 14 and are provided with juxtaposed solution injection ports or slits 16, 18 defining a fluid injection site for injecting solution under pressure into channel 13 on opposite sides of the film F. A pair of manifold plates 20, 22 having openings 24, 26 aligned with injection slits 16, 18 respectively are attached to the processor plates 10, 12 for supplying solutions to the injection slits. Alternatively, the manifold plates 20, 22 may be replaced with a direct feeding manifold such as that shown in FIG. 5. The system plumbing has been omitted to clarify the basic boundary layer concept.

The basic solution flow path is indicated by the arrows in FIG. 1. Fluid under pressure will enter channel 13 on both sides of the film F and create a fluid cushion under pressure on opposite sides of the film which will support the film and permit it to be transported through the channel 13 without contact with the plates 10, 12. The fluid will move to the ends of the channel 13 with a laminar flow where it will be discharged. If the treating fluid is a liquid it may be collected in a sump (not shown) and be recirculated to the manifold by pumps and conduits (also not shown). Also, the solution may be replenished as described below. It will also be apparent that the processor may be used in a submerged state similar to the processor disclosed in FIG. 5 and 6.

Figure 8:
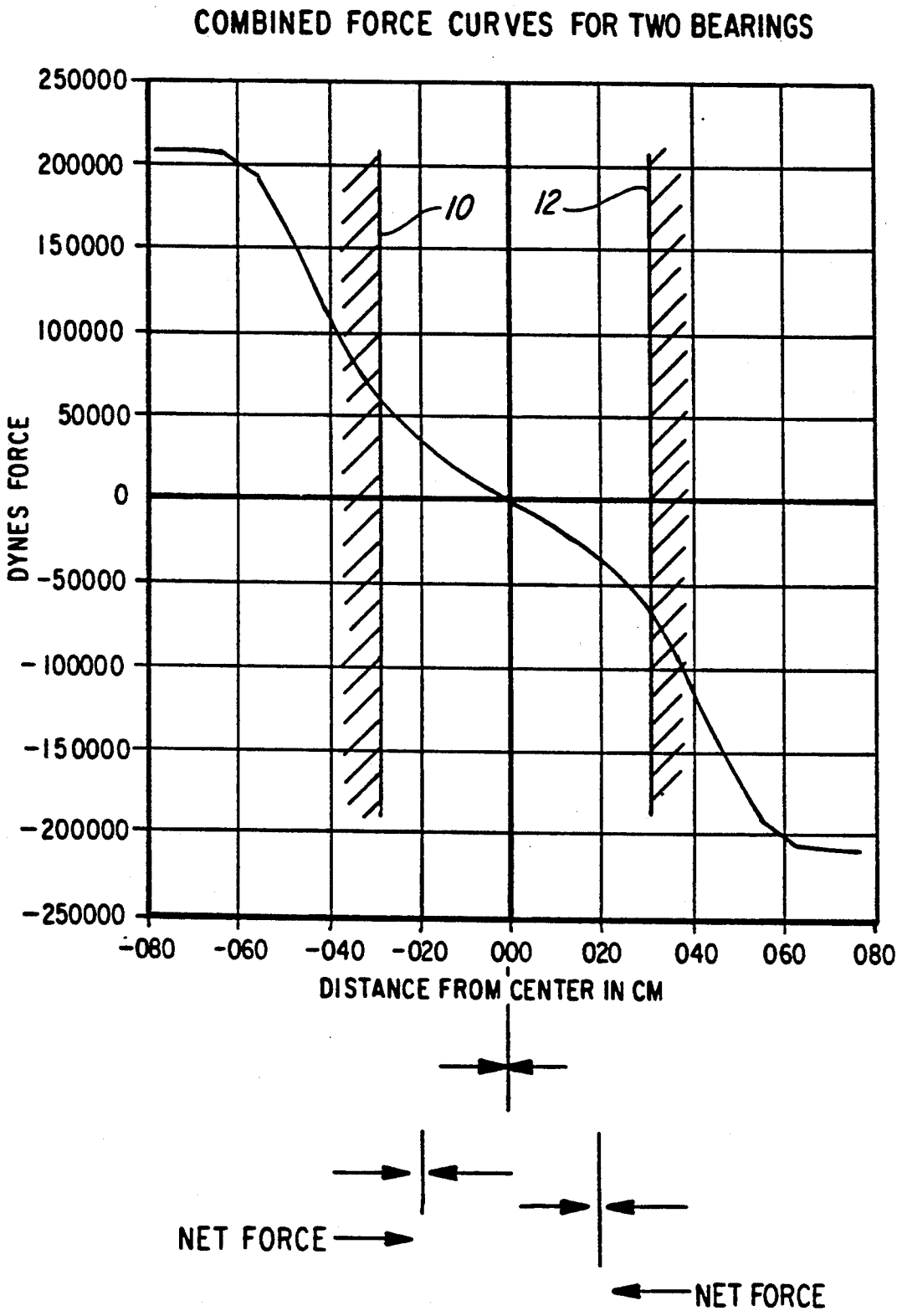
FIG. 8 is a force curve illustrating the stabilizing action of the fluid cushions.

The fluid cushions on opposite side of the film apply pressure forces to the film which tend to stabilize it and support it in a position centered between the plates 10, 12. More specifically, if the film attempts to move off center, it will move closer to one plate than the other. The closer spacing to the one plate will decrease the thickness of the flow channel on that side of the film and decrease the flow within the channel on that side. The reduced flow rate will decrease the drop in pressure across the orifice (opening 24) on that side of the film. This will increase the fluid pressure in the thinner channel relative to that of the thicker channel producing a net force on the film tending to restore it to its center position. This stabilizing concept is illustrated by the curve depicted in FIG. 8 which is a plot of force (Dynes) exerted against the film vs film distance from the center of the channel.

In accordance with the invention, the length L of channel 13 on each side of the injection slits will have a finite length related to the increase in thickness of the chemical boundary layer 13, so that the solution is discharged at the ends of the channel 13 when the boundary layer reaches a thickness at which the solution is no longer efficiently transferring chemicals (or heat). More specifically, in the region of the injection slits 16, 18, maximum transfer will occur. However, as the solution moves away from the injection slits in the paths depicted by the arrows, the chemical boundary layer B will gradually increase in thickness as indicated in FIG. 1. At the point where the boundary layer has a thickness which renders the chemical or heat transfer efficiency less than a desired value, it is preferably discharged at the ends of the channel 13 and recirculated or replenished. This concept thus maximizes the effectiveness of the chemical or heat transfer process.

The effectiveness of the chemical or heat transfer process is enhanced in two ways. First by minimizing the length L, the distance over which the boundary layer is permitted to develop. Second, the system parameters are selected to establish reasonably high fluid velocities in the laminar fluid flow region to minimize the rate at which the boundary layer is allowed to grow. A small plate separation is used to achieve high fluid velocities with laminar flow. Short distance and high velocity laminar flow result in a slowly developing boundary layer and efficient chemical or heat transfer with laminar flow.

The invention uniquely uses laminar flow to advantageously achieve chemical mass or heat transfer rates that actually exceed those provided by all but the most turbulent flows at a fraction of the power requirements. The power requirements are very low because most of the fluid flow energy is dissipated at the film surface due to shear forces between the liquid and the film. This is a unique alternative to the use of turbulent flows which dissipate their flow energy through shear forces within the fluid itself—not at the film surface.

The length of the fluid path L was determined in the following manner. It was assumed that the similarities between heat and mass transfer permit conclusions derived from heat transfer studies render conditions of incompressible flow to be extended to the transfer of chemical mass in the liquid domain.

There are several ways to specify the effectiveness of heat or chemical mass to transfer. As disclosed in Fluid Dynamics and Heat Transfer, Knudsen and Katz, McGraw Hill, 1958, p. 366, Eg. 13-12, the heat-transfer coefficient $h_{heat}$ of a laminar flow along a surface as a function of x (distance from leading edge of a flow path) may be expressed by the following equation:

$$h_{heat} = \frac{K}{0.893}\left[\frac{c}{9\alpha x}\right]^{\frac{1}{3}}$$

where:

K=thermal conductivity $\alpha$=thermal diffusivity=$K/C_pP$ c=slope of velocity profile=$u_\infty/y$ $u_\infty$=velocity of fluid parallel to the surface y=distance from surface Cp=specific heat of fluid P=Fluid Density To develop the mass transfer analogy the following assumptions can be made:

For water: $C_pP=1;\alpha=K$

For liquid: K=D (chemical diffusivity)

Therefore the chemical mass transfer coefficient may be expressed by the following equation:

chemical mass transport coefficient and relevant device $$h_{CHEM} = \frac{D}{.893}\left[\frac{u_\infty}{9Dxy}\right]^{\frac{1}{3}} = .538\left[\frac{D^2u_\infty}{xy}\right]^{\frac{1}{3}}$$

This equation defines the relationship between the and fluid properties for the specific parallel plate flow concept incorporated into the processor of FIG. 1 and other embodiments described below. From this equation it can be determined what variables might be manipulated to maximize this coefficient and resulting mass transfer rate. Specifically, this invention involved the realization that $h_{CHEM}$ is maximized by increasing u, decreasing y and decreasing x.

If it is assumed that a typical processing fluid temperature is 95 degrees Fahrenheit then the following variables have the values indicated:

$D=5.0\times10^{-6}$ cm²/sec $u_\infty$=25.4 cm/sec y=0.075 cm

It will be apparent that $h_{CHEM}(x)$ will increase as x increases. An average value of $h_{CHEM}$ over the distance L can be obtained by integrating $h_{CHEM}(x)$ over a distance X=L as follows:

$$\bar{h}_{CHEM} = 1.467\left[\frac{D^2u_\infty}{Ly}\right]^{\frac{1}{3}}$$

If L is assumed to have a value of 1.0 cm, then $$h_{CHEM} = \frac{1.467\,(5\times10^{-6}\ \text{cm}^2/\text{sec})^2\times(25.4\ \text{cm/sec})}{(1.0\ \text{cm})\ (.075\ \text{cm})^{\frac{1}{3}}}$$

$$\bar{h} = .0030\ \text{cm/sec}$$

The table set forth below indicates ranges for the system variables from which minimum, maximum and nominal values of chemical mass transfer coefficients were computed.

| | Min. | Max. | Nominal |
|---|---|---|---|
| $u_\infty$ | 20 cm/sec | 100 cm/sec | 25.4 cm/sec |
| y | .05 cm | 0.10 cm | 0.75 cm |
| x | .25 cm | 2.5 cm | 1.0 cm |

| | | |
|---|---|---|
| For Max $\bar{h}_{CHEM}$: | $u_\infty$ = | 100 cm/sec |
| | y = | 0.05 cm |
| | x | .25 cm |
| | $h_{CHEM}$ = | .0086 cm/sec |
| Nominal $\bar{h}_{CHEM}$ | h = | .0030 cm/sec |
| | (variables set forth above) | |
| Min $\bar{h}_{CHEM}$: | $u_\infty$ = | 20 cm/sec |
| | y = | 0.10 cm |
| | x = | 2.5 cm |
| | $h_{CHEM}$ = | .0018 cm/sec |

Considering the above data it is apparent mass transfer value in the following range achieves optimum results for the invention:

$$.010\ \text{cm/sec} \geqq \bar{h}_{CHEM} \geqq .001\ \text{cm/sec}$$

This range is based on a chemical diffusivity D equal to $5.0\times10^{-6}$ cm²/sec. Other chemical species would have different values, even within the same solution and it is to be understood that there is a separate distinct boundary layer for each chemical species.

This mathematical determination of the relevant dimensions resulted in a fluid treatment apparatus having laminar fluid flow while maximizing the efficiency of the treating fluid by preventing increase of the boundary layer thickness beyond a predetermined value. Thus the efficiency is maximized by limiting the thickness of the boundary layer. Preferably the maximum thickness is such as to maintain an aqueous chemical mass transfer rate that exceeds the transfer rate within the film by a reasonable design margin. To compare the value of $h_{CHEM}$ with what one might expect to achieve in conventional tank and roller transport processing the hydrodynamics of roller transport processing was considered to be analogous to flow of liquid over a stationary flat plate. The equations which dictate the chemical mass transfer coefficient for this condition are disclosed in *Fluid Dynamics and Heat Transfer,* Knudsen and Katz, McGraw-Hill, 1958, p.482, Fg 17-39. The relevant equation is:

$$h^{(x)}_{CHEM} = .323D\left[\frac{u_\infty}{\nu x}\right]^{\frac{1}{2}}\left[\frac{\nu}{D}\right]^{\frac{1}{3}}$$

Where:

D is chemical diffusivity $u_\infty$ is free stream velocity v is kinematic viscosity By integration over the distance x=L, the average value of $h_{CHEM}$ over the distance L can be determined:

$$\bar{h}_{CHEM} = .646\frac{D}{L}\left[\frac{u_\infty L}{\nu}\right]^{\frac{1}{2}}\left[\frac{\nu}{d}\right]^{\frac{1}{3}}$$

For comparison assume that for the roller transport case, $D=5\times10^{-6}$ cm²/sec (as before), L=1.0 cm, v=0.0072 cm²/sec these corresponding assumptions $h_{CHEM}$=0.0022, 27 percent less than the value of 0.0030 achieved with the invention.

In addition to the higher average value of $h_{CHEM}$ the invention has many distinct additional advantages. Most apparent is the fact that a value of 0.0022 for $h_{CHEM}$ would be extremely difficult to achieve for a number of reasons. For example, roller spacings of 1.0 cm would require very small rollers spaced very close together and many supporting parts. Also, the above equalizers for the roller transport apparatus assume that the rollers reduce the chemical boundary layer thickness to zero as the film contacts each successive roller. This is not the case. The film "hydroplanes" on each roller leaving some residual chemical boundary layer in place. This increases the mass transfer coefficient by a fixed amount over the entire film surface. In addition, roller transport tank processors require the film to move at high speeds creating difficult transport reliability problems. Also, reasonable development times require very large machines.

As a practical matter, the same parameters cannot be assumed for a roller transport tank processor. More practically, L would be 4 cm or more, $U_\infty$ would be in the range of 2.5–5.0 cm/sec and more likely 5.0 cm in the worst case situation. With these constraints $\bar{h}_{CHEM}$ would be 0.00048–84 percent less than the value of 0.0030 calculated for a parallel plate processor in accordance with the invention.

Figure 7:
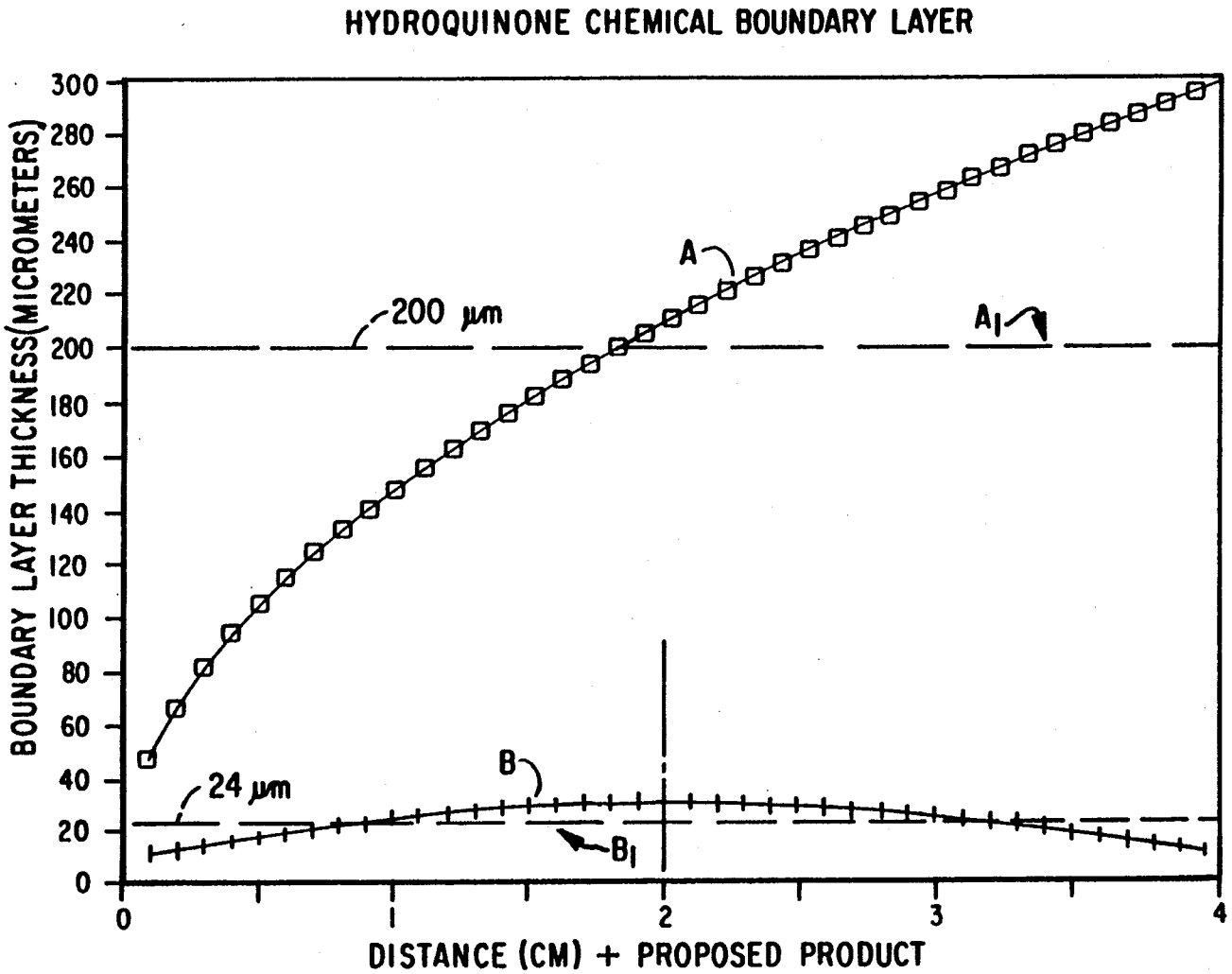
FIG. 7 is a graph illustrating boundary thickness of the processor illustrated in FIG. 2 compared with the boundary layer thickness of a prior art processor.

FIG. 7 is a graph illustrating the results achieved with the invention incorporated into a chemical treating apparatus using hydroquinone as the treating fluid in comparison with a conventional roller transport processor. Curve A is a plot of boundary layer thickness vs. distance from the lead edge of a fluid path in a prior art roller transport processor. Curve B is a similar curve for a prototype processor incorporating the present invention. Curve B represents the boundary layer thickness with injection slits located at the far left and far right of the diagram and the evacuation slit located in the center. The difference in average boundary layer thickness (dashed lines $A_1$ and $B_1$) is large and indicates the unexpected results achieved with the invention.

Figure 2:
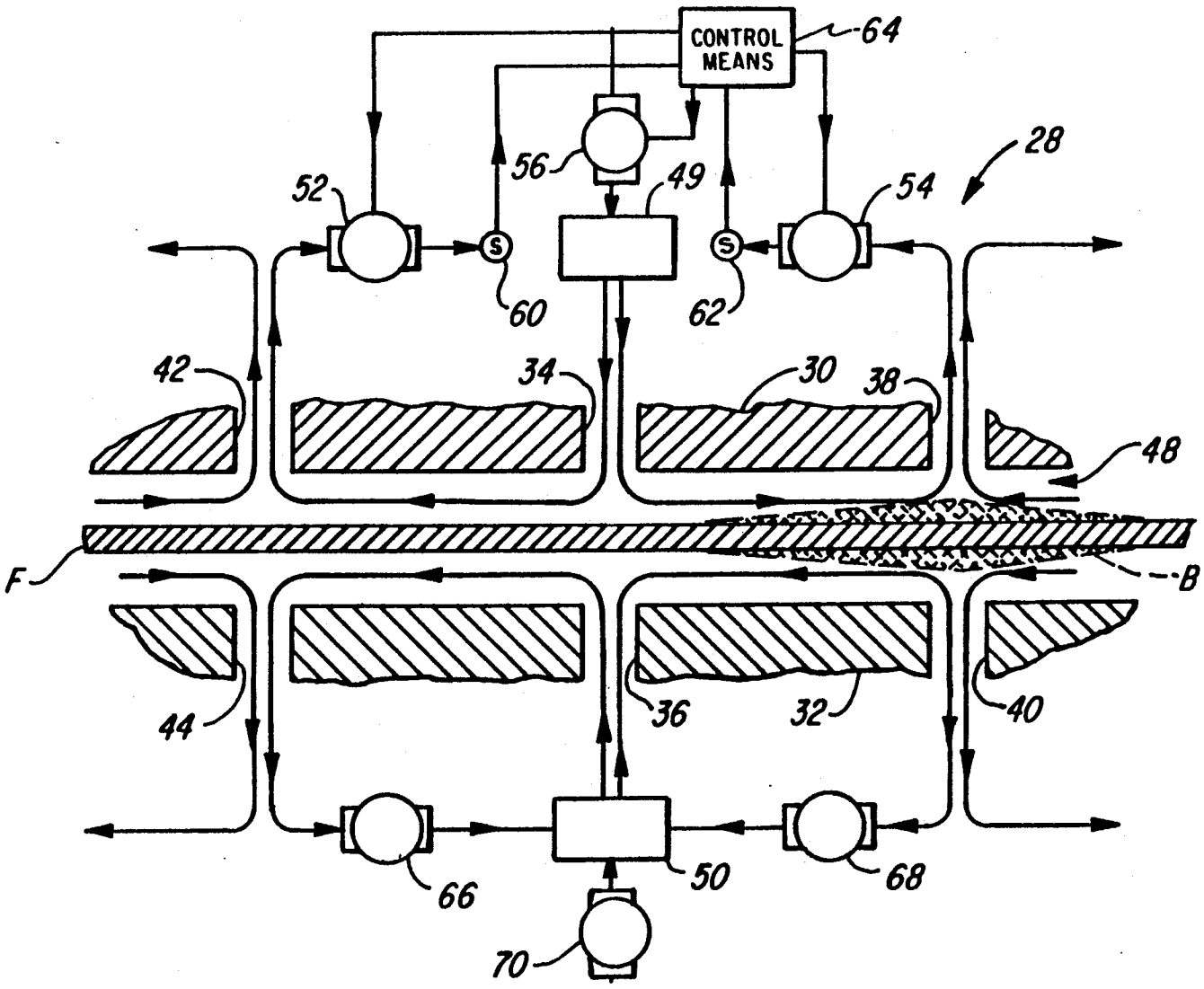
FIG. 2 is a schematic sectional view illustrating the basic fluid circulation paths of a parallel processor in accordance with the invention.

Referring to FIG. 2 of the drawings, a parallel plate processor 28 is shown which incorporates the invention described in connection with FIG. 1. This processor comprises a pair of spaced parallel plates 30, 32 having a pair of juxtaposed injection slits 34, 36 and two pairs of juxtaposed evacuation slits 38, 40 and 42, 44. The plates may be supported by end walls (not shown) similar to the FIG. 1 assembly to define a channel 48 therebetween through which the film F is transported such as by rollers as described below.

The solution circulation paths are illustrated in FIG. 2 by the arrows which are also schematically representative of system plumbing. It is to be understood that the processor depicted may include additional injection and evacuation slits by extending the length of the plates 30 and 32. Thus, the circulation pattern depicted schematically may be repeated by providing additional alternating solution injections and evacuations depending on the requirements of a particular application.

Referring now to the circulation pattern, solution is supplied to injection ports 34 and 36 from mixing tanks 48, 50 respectively. Fluid will exit channel 48 via evacuation slits 42, 44 and 38, 40 as indicated by the arrows. A portion of the solution exiting via slits 38 and 42 may be recirculated by pumps 52, 54, respectively, to mixing tank 48 and the remainder circulated to the adjacent mixing tanks (not shown) in the series, as indicated by the arrows. If a need for replenishment exists, fresh solution may be supplied to tank 48 by a pump 56. The need for such replenishment may be sensed by sensors 60, 62 connected to the return inlet conduits to the mixing tank 48 and coupled to a control means 64 which will activate pump 56 when the need exists. Control means 64 can also be arranged to control pumps 52, 54.

Slits 36, 40, 44 are similarly connected to mixing tank 50, pumps 66, 68 and 70 being provided to accomplish such recirculation and replenishment in the identical manner described in connection with tank 48. Also pumps 68, 70, 72 may be controlled by control means (not shown) and sensors (not shown) identical to control means 64 and sensors 60 and 62.

For simplicity, two recirculation and replenishment systems have been shown. However, as will be obvious to those skilled in the art, the tanks 48, 50 may be replaced with a single tank connected to both injection slits 34, 36 and solution can be recirculated from evacuation slits 42, 44 and 38, 40 to such single tank. Alternatively fluid ducts and pumps with adequate capacity could be used without a specific tank.

Figure 3:
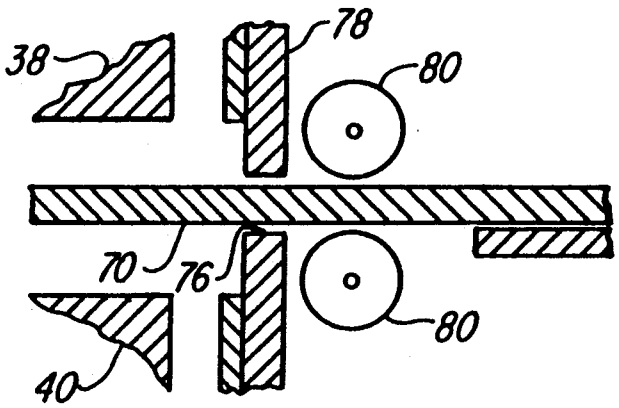
FIG. 3 is a section showing the end wall and exit or entrance of the processor illustrated in FIG. 2.

In operation of the processor shown in FIG. 2, solution will be circulated from tanks 48, 50 to injection slits 34, 36 to thereby create solution cushions under pressure on both sides of the film. From each silt, solution will flow right and left on both sides of the film as indicated by the arrows. At each evacuation slit, solution from the two adjacent injection ports will exit as indicated by the arrows. If the processor is a simple processor having only the ports shown in FIG. 2, the solution exiting slits 42, 44 and 38, 40 would only be that entering via slits 34, 36. Such a processor would be provided with an end wall with a slit 76 in an end wall 78 for exiting of the film between a pair of squeegee and transport rollers 80, as shown in FIG. 3. Similar structure may be provided at the entrance to the processor to transport film into the processor.

Similar to the processor shown in FIG. 1, solution entering the channel 48 will have maximum chemical or heat transfer adjacent the injection slits 34, 36. As it flows toward the evacuation slits, for example, slits 38 and 40, the boundary layer B will increase in thickness, as indicated in FIG. 2. As in the processor shown in FIG. 1, it is desirable to exit the solution when the boundary layer becomes so thick as to render the processing inefficient. Accordingly, length of channel 48 between adjacent slits is sized to exit the solution into an evacuation slit when a predetermined boundary layer thickness exists. As indicated above, the maximum thickness is such as to maintain an aqueous chemical mass transfer rate that exceeds the transfer rate within the film by a reasonable margin. Also, as discussed in connection with the FIG. 1 embodiment, the plate separation is made small to achieve high fluid velocities in the laminar flow region.

Figure 4:
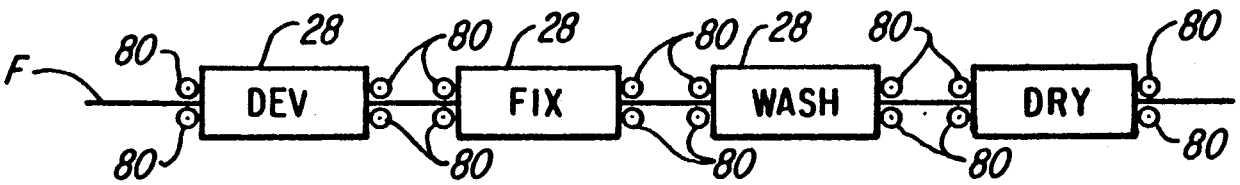
FIG. 4 is a schematic illustration of a plurality of serially arranged processors.

It will be apparent to those skilled in the art that by providing appropriate valves and plumbing, different solutions may be successively supplied to the processors disclosed herein to sequentially subject the film to a series of treatments, e.g., developing fixing, washing and drying. Alternately, a series of separate processors such as shown in FIG. 4 may be provided with each processor subjecting the film to a different treatment. Nip rollers 80 would be provided at the entrance and exit of each processor to transport the film along the treatment path. The exit rollers of wet solution processors would be squeegee rollers to remove excess solutions.

If the system of FIG. 4 is used to process sheet film (e.g., X-ray film), the processor would be sized and spaced so that the distance between adjacent pairs of nip rollers is less than the length of the sheet. The invention has particular utility in processing sheet film because the increased processing efficiency enables use of smaller processing units to reduce machine size or to permit processing of small film sheets.

Figure 5:
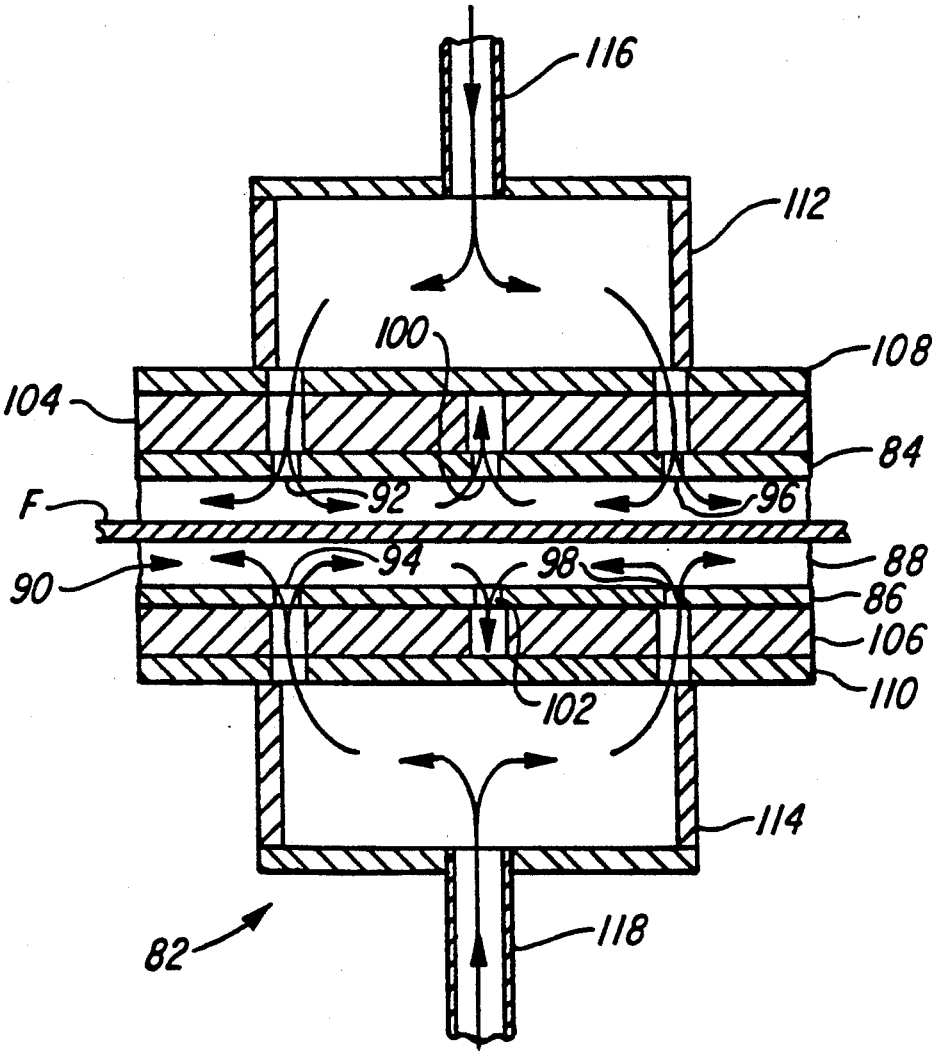
FIG. 5 is a sectional view illustrating another embodiment of the invention.
Figure 6:
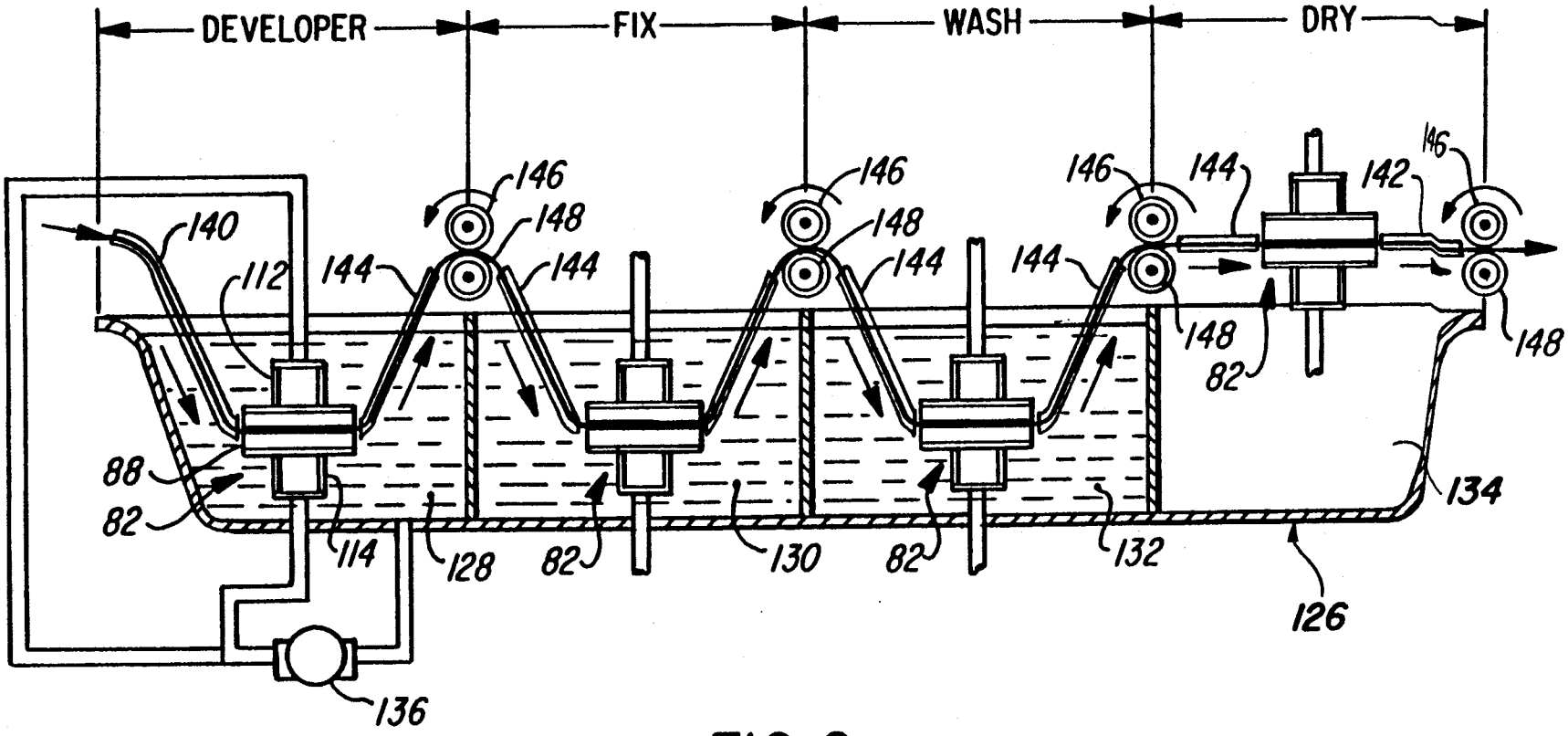
FIG. 6 is a partial sectional view illustrating the application of the embodiment shown in FIG. 5 to the processing of light sensitive material.

Referring to FIG. 5 and 6 of the drawings, still another embodiment of the invention is disclosed for use in a submersed condition. This embodiment comprises a parallel plate processing unit 82 having a pair of parallel plates 84, 86 positioned and supported by side walls 88 to define a channel 90 for receiving a web F of light sensitive material such as photographic film. The plates 84, 86 are provided with first and second pairs of juxtaposed injection slits 92, 94 and 96, 98 disposed on opposite sides of a pair of juxtaposed evacuation slits 100, 102. The injection and evacuation slits are sized and spaced as described above to evacuate fluid from the channel 90 when the boundary layer of the treatment fluid becomes thick enough to render its use inefficient.

The plates 84, 86 are attached to manifold plates 104, 106 respective, which in turn are attached to outer plates 108, 110. Manifold housings 112, 114 are attached to plates 108, 110 respectively and have chambers for receiving treating fluid under pressure via conduits 116, 118, respectively. The pressurized fluid in housings 112, 114 will flow to the injection ports 92, 94 and 96, 98 via openings in plates 104, 108 and plates 106, 110 and will be injected into channel 14 to establish a laminar flow of fluid on opposite sides of the film in one direction to the evacuation ports and in the opposite direction to the open ends of channel 96. Fluid evacuated from the channel 96 by evacuation ports 100, 102 will flow out the sides of the unit via openings in plates 104, 106. It is to be understood that, as described in connection with FIG. 2, additional injection and evacuation ports may be provided depending on the requirements of a particular treatment process.

FIG. 6 depicts the use of processors of the type shown in FIG. 5 or FIG. 1 to process photographic film. More specifically, an elongated housing 126 is provided with a plurality of treatment chambers 128, 130, 132, 134 for film development, fixing, washing and drying, respectively, as indicated in FIG. 6. A processing unit 82 is suitably supported in each chamber with the units 82 in chambers 128, 130, 132 submersed in the liquid processing solutions, as indicated. Each processing unit may be provided with a circulation system, such as that shown in connection with the unit 82 in chamber 128. In its most simple form the system would include a pump 136 having its inlet connected to the chamber 128 and its outlet connected to the manifold housings 112, 114 whereby fluid will be continuously circulated from the chamber to the injection ports 92, 94 and 96, 98. Fluid discharged from the evacuation ports 100, 102 and the ends of the channel 96 will mix with the fluid in chamber 128. As will be apparent to those skilled in the art, the mixing action can be augmented by providing a mixing impeller (not shown) in chamber 128. Also, suitable replenishment means (not shown) may be provided to periodically supply fresh fluid to the system.

The film transport means comprises identical entrance and exit chutes 140, 142 for guiding the film into the first chamber 128 and exiting the film from the last chamber 134. Identical chutes 144 and pairs of nip rollers 146, 148 (one pair between adjacent chambers) transport the film from chamber to chamber. At each processing unit, the associated chutes will guide the film into and out of the channel 96 and next nip rollers.

Those skilled in the art to which the invention relates will appreciate that other substitutions and modifications can be made to the described embodiment without departing from the spirit and scope of the invention as described by the claims below.

What is claimed is:

1. Apparatus for subjecting a web to treatment fluid, said apparatus comprising:

means defining a fluid treatment channel for receiving the web, said means defining in said channel an elongated injection opening for injecting fluid into the channel and an elongated evacuation opening, said openings extending transversely of said channel;

means for supplying treatment fluid under pressure to said injection opening to inject treatment into said channel and establish fluid flow from said injection opening to said evacuation opening, said evacuation opening being spaced from said injection opening by a predetermined distance to effect evacuation of the fluid when the boundary layer of the fluid reaches a predetermined thickness to maintain an energy transfer rate in the fluid that exceeds the energy transfer rate within the web.

2. In apparatus for subjecting a web to treatment fluid, the improvement comprising:

means defining a narrow elongated fluid treatment channel for receiving the web, said means defining a plurality of elongated injection openings spaced along said channel for injecting treatment fluid into said channel and defining at least one elongated evacuation opening associated with each of said injection openings for evacuating treatment fluid from said channel, said openings extending transversely of said channel;

means for supplying treatment fluid under pressure to said injection openings to inject treatment fluid into said channel to establish a high velocity fluid flow from said injection openings to said evacuation openings, said evacuation openings being spaced from said injection openings by a predetermined distance to effect evacuation of treatment fluid from said channel when the chemical boundary layer of the fluid reaches a predetermined thickness to limit growth of the chemical boundary layer in thickness along said channel.

3. Apparatus according to claim 2 wherein the spacing between each said injection opening and each said associated evacuation opening is such that the chemical mass transfer rate of the fluid in the said high velocity fluid flow is within the range of about 0.010 cm/sec to 0.001 cm/sec.

4. In apparatus for subjecting a web to treatment fluid, the improvement comprising:

means defining a narrow elongated fluid treatment chamber for receiving the web, said chamber having at least one elongated injection opening for injecting treatment fluid into the chamber and having at least one elongated evacuation opening associated with said injection opening for evacuating fluid from said chamber, said injection and evacuation openings extending transversely of said chamber;

means for supplying treatment fluid under pressure to said injection opening to inject treatment fluid into said chamber to establish a high velocity fluid flow from said injection opening to said evacuation opening, said evacuation opening being spaced from said injection opening by a predetermined distance such that the chemical mass transfer rate of the fluid in said high velocity fluid flow is within the range of about 0.010 cm/sec to 0.001 cm/sec.

5. In apparatus for subjecting a web to treatment fluid, the improvement comprising:

means defining a narrow elongated fluid treatment channel for receiving the web, said means defining a plurality of elongated injection openings spaced along said channel for injecting treatment fluid into said channel and defining at least one elongated evacuation opening associated with each of said injection openings for evacuating treatment fluid from said channel, said openings extending transversely of said channel;

means for supplying treatment fluid under pressure to said injection openings to inject treatment fluid into said channel to establish a high velocity fluid flow from said injection openings to said evacuation openings, said evacuation openings being spaced from said injection openings by a predetermined distance to effect evacuation of treatment fluid from said channel when the thermal boundary layer of the treatment fluid reaches a predetermined thickness to limit growth of the thermal boundary layer in thickness along said channel.

6. In a apparatus for subjecting a web to treatment fluid, the improvement comprising:

means defining a narrow elongated fluid treatment channel for receiving the web, said means defining a channel having a plurality of elongated injection openings spaced along the channel for injecting treatment fluid into the channel and at least one elongated evacuation opening associated with each of said injection openings for evacuating fluid from said channel, said openings extending transversely of said channel;

means for supplying treatment fluid under pressure to said injection openings to inject treatment fluid into said channel and to establish a flow of treatment fluid from said injection openings to said evacuation openings, said evacuation openings being spaced from said injection openings by a predetermined distance to effect evacuation of treatment fluid from said channel when the boundary layer of the treatment fluid reaches a predetermined thickness to limit growth of the boundary layer in thickness along said channel.

7. In apparatus for subjecting a web to contact with a treatment fluid which develops a fluid boundary layer having reduced treatment effectiveness as a result of treatment of the web, the improvement comprising:

means defining an elongated fluid treatment channel for receiving the web;

means for evacuating fluid from said channel at a plurality of evacuation sites;

means for injecting treatment fluid into said channel at a plurality of injection sites to establish a flow of treatment fluid from said injection sites to said evacuation sties;

said evacuation sites being spaced from said injection sites by predetermined distances to effect evacuation of the treatment fluid from said channel when the boundary layer of the fluid reaches a predetermined thickness to limit growth of the boundary layer in thickness along said channel.

8. In an apparatus for subjecting a web to contact with a treatment fluid which develops a fluid boundary layer having reduced treatment effectiveness as a result of treatment of the web, the improvement comprising:

means for defining an elongated treatment channel for receiving the web;

a plurality of injection openings disposed along said channel for injecting treatment fluid into said channel into contact with the web;

a plurality of evacuation openings disposed along said channel for evacuating treatment fluid from said channel; and means for supplying treatment fluid under pressure to said injection openings to inject treatment fluid into said channel and establish fluid flow from said injection openings to said evacuation openings, said injection openings alternating with said evacuation openings along said channel and spaced from said evacuation openings by predetermined distances so that treatment fluid is evacuated from said channel through said evacuation openings when the boundary layer reaches a predetermined thickness to limit growth of the boundary layer in thickness in said channel.

* * * * *